US008403321B2

(12) United States Patent
Chen

(10) Patent No.: US 8,403,321 B2
(45) Date of Patent: Mar. 26, 2013

(54) PAPER-FEEDING APPARATUS FOR PRINTING APPARATUS

(75) Inventor: Jeng-Che Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/272,544

(22) Filed: Oct. 13, 2011

(65) Prior Publication Data

US 2012/0306145 A1 Dec. 6, 2012

(30) Foreign Application Priority Data

May 31, 2011 (TW) ..... 100119120 A

(51) Int. Cl.
*B65H 1/00* (2006.01)

(52) U.S. Cl. ..... 271/161; 271/145

(58) Field of Classification Search ..... 271/145, 271/161, 160

See application file for complete search history.

(56) References Cited

U.S. PATENT DOCUMENTS

| | | | | |
|---|---|---|---|---|
| 6,015,143 | A * | 1/2000 | Jimenez et al. | 271/4.1 |
| 6,231,043 | B1 * | 5/2001 | James et al. | 271/209 |
| 6,902,161 | B2 * | 6/2005 | Gordon et al. | 271/161 |
| 7,950,650 | B2 * | 5/2011 | Koyanagi | 271/161 |

FOREIGN PATENT DOCUMENTS

JP 06191649 A * 7/1994

* cited by examiner

*Primary Examiner* — Patrick Cicchino
(74) *Attorney, Agent, or Firm* — Altis Law Group, Inc.

(57) ABSTRACT

A paper-feeding apparatus for a printing apparatus includes a paper input port, a first paper holding tray and a second paper holding tray. The paper input port curves the sheets of paper fed into it so as to increase the rigidity of the stack and the friction between each sheet. The additional rigidity of the stack allows the use of a lightweight paper tray in holding the stack.

4 Claims, 3 Drawing Sheets

PAPER-FEEDING APPARATUS FOR PRINTING APPARATUS

BACKGROUND

1. Technical Field

The present disclosure relates to a paper-feeding apparatus for printing apparatuses.

2. Description of Related Art

A printing apparatus, such as a printer or a photocopying machine, feeds a sheet of paper from an input tray, prints an image on the paper, and discharges the printed paper to an output tray. In most office environments, a single printing apparatus is used by a plurality of users. A large number of paper sheets are laid on the input tray of the printing apparatus. The height and strength of the input tray needs to be increased as the number of sheets increases, which increases the cost.

Therefore there is a need for improvement in the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
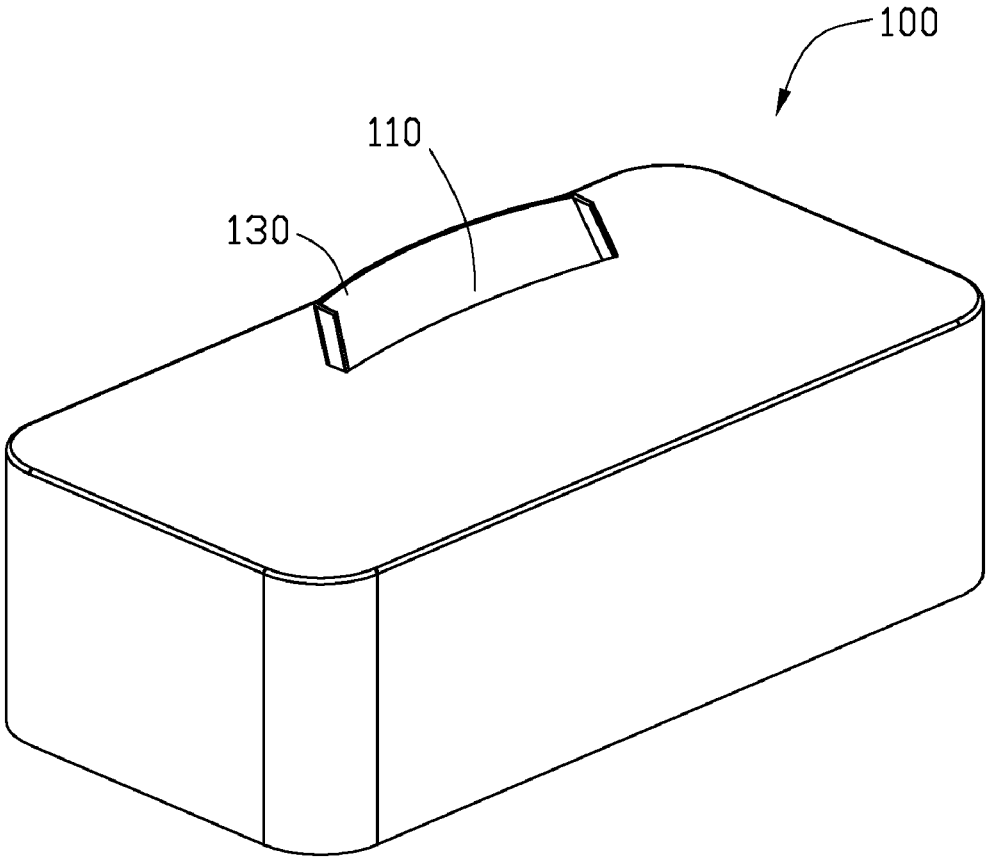
FIG. 1 is an isometric view of a paper-feeding apparatus for printing apparatuses, in accordance with an embodiment.
Figure 2:
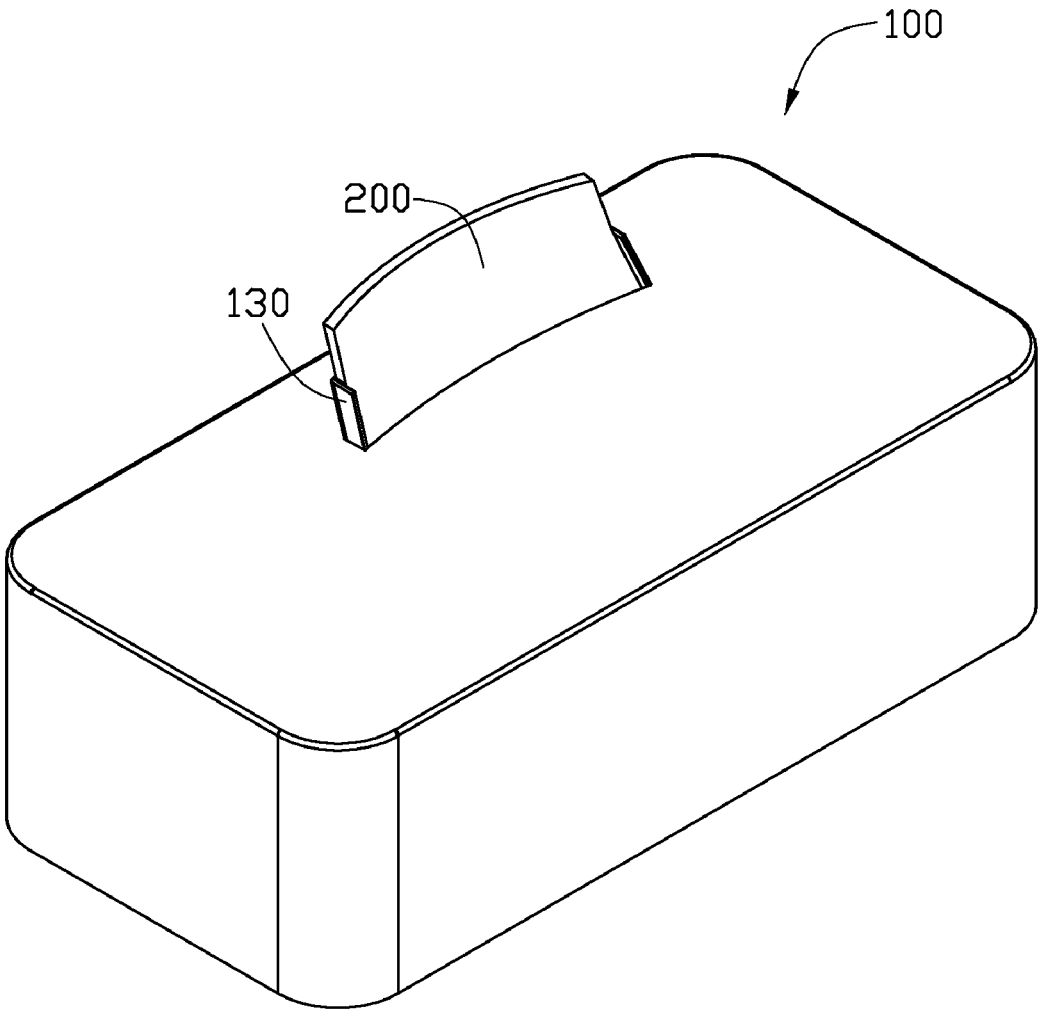
FIG. 2 is an isometric view of the paper-feeding apparatus for printing apparatuses, with a sheet of paper lying on the input tray of the printing apparatus.
Figure 3:
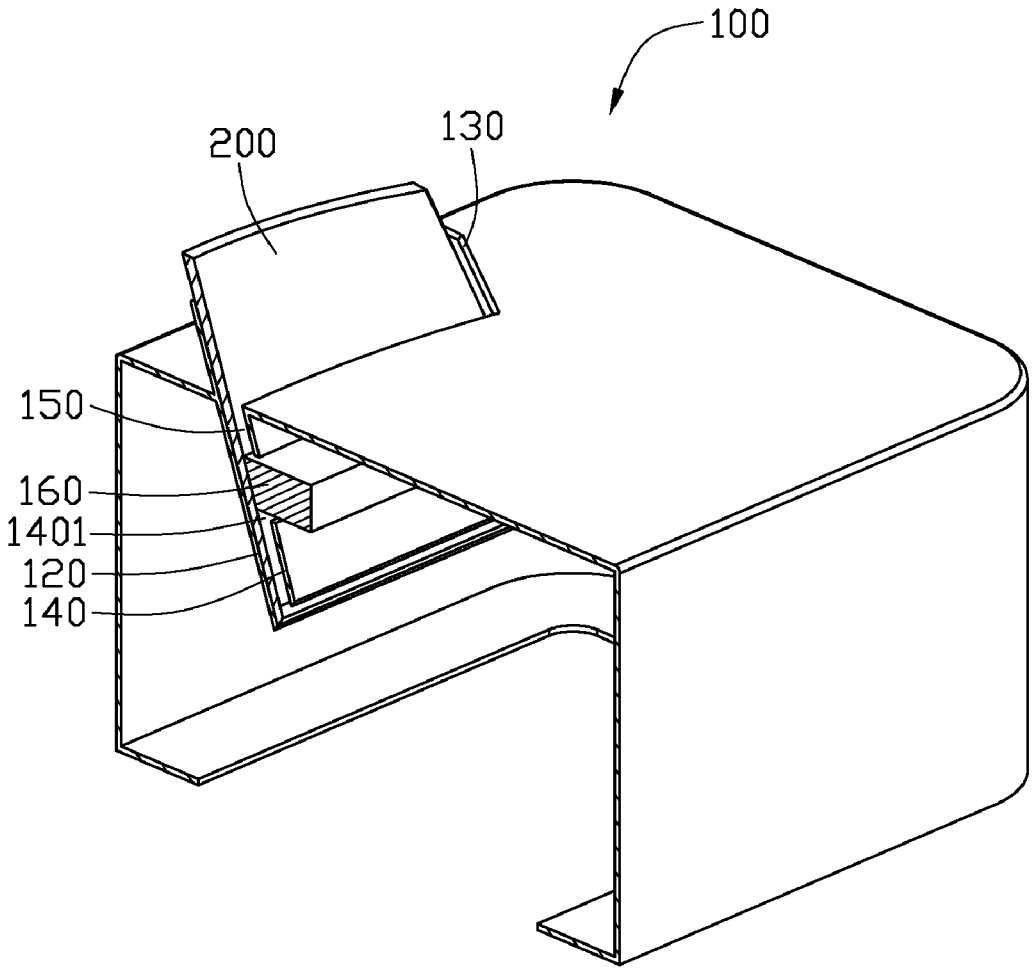
FIG. 3 is a sectional view of the paper-feeding apparatus for printing apparatus of FIG. 2.

Referring to FIGS. 1 to 3, a paper-feeding apparatus for printing apparatuses supports a plurality of papers 200 placed at a paper input port 110 of a printing apparatus 100.

The paper-feeding apparatus includes a first paper holding tray 120 extending downwards from a first edge of the paper input port 110 and a second paper holding tray 130 extending upwards from the first edge of the paper input port 110. The first paper holding tray 120 is positioned inside the printing apparatus 100. The second paper holding tray 130 is positioned outside the printing apparatus 100. The second paper holding tray 130 is curved vertically so as to bend the papers 200 placed at the paper input port 110.

A front plate 140 extends downwards from a second edge of the paper input port 110. The front plate 140 is parallel to the first paper holding tray 120 and positioned inside the printing apparatus 100. Between the first paper holding tray 120 and the front plate 140 there is a paper accommodating space 150. The front plate 140 is interrupted by a rectangular opening 1401 which accommodates a cubic pressing block 160. The pressing block 160 abuts the papers 200 in the paper accommodating space 150. The pressing block 160 presses the papers 200 against the first paper holding tray 120 and thus into a curved shape. In one embodiment, the pressing block 160 is pressed through the opening 1401 by a spring (not shown) to apply constant spring pressure to the papers 200 in the paper accommodating space 150.

As the papers 200 placed at the paper input port 110 are bent into a curve by the second paper holding tray 130, the lengthwise rigidity of the papers 200 is increased. Typically, the rigidity of the papers 200 is represented by a moment of inertia which is inversely proportional to the movement of the papers 200 subject to an external force. When the rigidity of the papers 200 is increased, more force is required to move an individual sheet of paper, and more force is required to move the stack of papers, simply by virtue of the additional friction between sheets of paper which are made to curve. The ability of the papers 200 to resist an external force when stacked together is strengthened and the papers 200 will be less readily disturbed in the paper input port 110. Therefore, the additional height and strength normally required for an external paper holding tray is avoided, or not required, which also decreases the costs. Furthermore, the pressing block 160 bends the papers 200 to slightly deform notwithstanding the thickness of the individual sheet of paper or the thickness of the stack of papers 200. The papers 200 still won't drop from the paper input port 110 even if the thickness of the papers 200 increases.

Even though numerous characteristics and advantages of the present disclosure have been set forth in the foregoing description, together with details of the structure and function of the disclosure, the disclosure is illustrative only, and changes may be made in detail, especially in the matters of shape, size, and the arrangement of parts within the principles of the disclosure to the full extent indicated by the broad general meaning of the terms in which the appended claims are expressed.

What is claimed is:

1. A paper-feeding apparatus for a printing apparatus comprising:

a paper input port comprising a first edge;

a first paper holding tray extended downwardly from the first edge of the paper input port, wherein the first paper holding tray is positioned in an inner space of the printing apparatus; and a second paper holding tray extended upwardly from the first edge of the paper input port, wherein the second paper holding tray is positioned in an outer space of the printing apparatus, and the second paper holding tray is curved vertically so as to bend a number of papers placed at the paper input port; wherein the paper input port further comprises a second edge, a front plate extends downwardly from the second edge of the paper input port, and the first paper holding tray and the front plate corporately define a paper accommodating space therebetween; an opening is defined on above the front plate for accommodating a pressing block therein, and the pressing block is adapted to abut the number of papers in the paper accommodating space to locate the number of papers on the first paper holding tray; and the pressing block is pressed through the opening by a spring to abut the number of papers in the paper accommodating space.

2. The rack frame of claim 1, wherein the front plate is parallel to the first paper holding tray and positioned in the inner space of the printing apparatus.

3. A paper-feeding apparatus for a printing apparatus comprising:

a paper input port comprising a first edge and a second edge;

a first paper holding tray extended downwardly from the first edge of the paper input port, wherein the first paper holding tray is positioned in an inner space of the printing apparatus;

a front plate extended downwardly from the second edge of the paper input port, wherein the first paper holding tray and the front plate corporately define a paper accommodating space therebetween for accommodating a number of papers; and a second paper holding tray extended upwardly from the first edge of the paper input port, wherein the second paper holding tray is positioned in an outer space of the printing apparatus, and the second paper holding tray is curved vertically so as to bend the number of papers placed at the paper input port; wherein an opening is defined on above the front plate for accommodating a pressing block therein, and the pressing block is adapted to abut the number of papers in the paper accommodating space to locate the number of papers on the first paper holding tray; and the pressing block is pressed through the opening by a spring to abut the number of papers in the paper accommodating space.

4. The paper-feeding apparatus of claim 3, wherein the front plate is parallel to the first paper holding tray and positioned in the inner space of the printing apparatus.

* * * * *